US005261667A

United States Patent [19]

Breeding

[11] Patent Number: 5,261,667

[45] Date of Patent: Nov. 16, 1993

[54] RANDOM CUT APPARATUS FOR CARD SHUFFLING MACHINE

[75] Inventor: John G. Breeding, St. Louis Park, Minn.

[73] Assignee: Shuffle Master, Inc.

[21] Appl. No.: 999,109

[22] Filed: Dec. 31, 1992

[51] Int. Cl.[5] ..... A63F 1/12

[52] U.S. Cl. ..... 273/149 R; 414/796; 414/796.6

[58] Field of Search ..... 273/149 R; 414/796, 414/796.1, 796.6

[56] References Cited

U.S. PATENT DOCUMENTS

| | | | |
|---|---|---|---|
| 1,955,926 | 4/1934 | Matthaey | 273/149 R |
| 3,067,885 | 12/1962 | Kohler | 414/796.6 |
| 3,588,116 | 6/1971 | Miura | 273/149 R |
| 4,162,649 | 7/1979 | Thornton | 414/796.1 X |
| 4,513,969 | 4/1985 | Samsel, Jr. | 273/149 R |
| 4,515,367 | 5/1985 | Howard | 273/149 R |
| 4,586,712 | 5/1986 | Lorber et al. | 273/149 R |
| 4,662,816 | 5/1987 | Fabrig | 414/796.1 X |
| 4,807,884 | 2/1989 | Breeding | 273/149 R |
| 5,078,405 | 1/1992 | Jones et al. | 273/309 |
| 5,102,293 | 4/1992 | Schneider | 414/796 |

*Primary Examiner*—Paul E. Shapiro
*Attorney, Agent, or Firm*—Dorsey & Whitney

[57] ABSTRACT

Apparatus for randomly cutting a deck of cards. The apparatus supports the deck of cards in stacked registration and slides the cards in a common direction to offset or "shingle" the cards in the deck. A probe is moved into the offset zone of the shingled deck and is caused to stop at a randomly selected location in the zone. Means is provided for moving the shingled deck relative to the probe to engage the leading edge of the probe with a card to separate the card from a contiguous card and randomly cut the deck into a sub-deck on one side of the probe and a sub-deck on the other side of the probe. The cut is preferably made in the range of cards 20–32 in a 52 card deck.

12 Claims, 4 Drawing Sheets

32
44
42
19
D
20
30
54
62
38
34
60
61
64
50
48
46
52
40
D1
D2
Z

RANDOM CUT APPARATUS FOR CARD SHUFFLING MACHINE

TECHNICAL FIELD

The present invention relates to devices for shuffling a deck of playing cards. In particular, it relates to automatic mechanical or electromechanical devices for shuffling playing cards, wherein the device is provided with apparatus for insuring a random cutting of the deck in preparation for shuffling the cards.

BACKGROUND OF THE INVENTION

Wagering games based on the outcome of randomly generated or selected symbols are well known. Such games include card games wherein the symbols may be the usual, widely recognized playing cards. Card games such as black jack, Pai Gow poker, Caribbean Stud TM poker and others are excellent card games for use in gambling casinos. Desirable attributes of casino games are that they are exciting, that they can be learned and understood easily by players, and that they move or can be played rapidly to their wager-resolving outcome.

The desired attributes of wagering games, particularly for those being used in casinos, have lead to the development of electromechanical or mechanical card shuffling devices. Such devices increase the speed of shuffling and dealing, thereby increasing playing time, adding to the excitement of the game while reducing the time required in preparing to play a game.

U.S. Pat. No. 4,513,969 (to Samsel, Jr.) and 4,515,367 (to Howard) disclose automatic card shufflers. The Samsel, Jr. patent discloses the use of microphotosensors to detect the presence or absence of a card or cards while shuffling is proceeding. For example, when a photosensor detects the absence of a card in a dispending compartment, a signal is transmitted to a timer circuit which then causes the energization of a solenoid to extract a card from a storage compartment. The Howard patent discloses the use of a lamp (or LED) that directs light toward a light sensitive element, whereby the light rays are blocked when a stack of cards reaches a particular height. The blockage or non-blockage of the light either energizes or turns off components of the machine to deliver cards from one portion of the machine to another. Neither of the Samsel, Jr. or Howard patents discloses apparatus for insuring a random cut of the cards in preparation for shuffling.

U.S. Pat. No. 4,586,712 (to Lorber, et al.) discloses an automatic shuffling apparatus directed toward reducing the dead time generated when a casino dealer manually has to shuffle multiple decks of playing cards. The borber, et al. apparatus has a container, a storage device for storing shuffled playing cards, a removing device and an inserting device for intermixing the playing cards in the container, a dealing shoe and supplying means for supplying the shuffled playing cards from the storage device to the dealing shoe. The apparatus is designed to intermix discarded playing cards into undealt decks under the programmed control of a computer, and includes a card jam light indicator for monitoring the passage, i.e., the presence or absence, of cards in various portions of the machine.

U.S. Pat. No. 4,807,884 (issued to John G. Breeding, the inventor of the present invention, and commonly owned) discloses an apparatus for automatically shuffling a deck of cards. The device includes a deck stacking zone, a carriage section for separating a deck into two portions, a sloped member positioned between adjacent corners of the separated deck, and an apparatus for snapping the cards over the sloped member thereby interleaving the cards. The sloped member is driven upwardly, raising or riffling the adjacent corners while simultaneously pushing one sub-deck toward the other thereby interleaving the cards. The interleaved sub-decks are then aligned and pushed together to provide a single randomly shuffled deck. The device is adapted to move repeatedly through this sequence. The Breeding patent is directed to providing a mechanized card shuffler whereby a deck may be shuffled often and yet the dealer still has adequate time to operate the game. Additionally, the Breeding shuffling device is directed to reducing the chance that cards become marked as they are shuffled and to keeping the cards in view constantly while they are being shuffled.

Although the Breeding card shuffling device provides a significant improvement in card shuffling devices, one unaddressed problem is that the device does not positively insure that the deck is cut at a random location. The device shown in the Breeding patent theoretically could cut the deck at the same location each time the deck is cut for shuffling. This fact, while not necessarily detrimental to a random shuffle, is undesirable in that it introduces a theoretical constant into the mechanical shuffling procedure that is not present with a manual shuffle. This lack of complete simulation of a manual shuffle, long accepted as a standard procedure by gaming commissions and casinos, makes a mechanical shuffling machine suspect as a substitute for manual shuffling and less desirable than a machine that insures a random cut.

Accordingly, there is a need for a simple, durable efficient means to positively insure that the cards are randomly cut in preparation for each shuffling of the cards.

SUMMARY OF THE INVENTION

The present invention comprises apparatus for randomly cutting a deck of cards including means for supporting the deck with the cards in stacked registration, means for sliding the cards with respect to adjacent or contiguous cards in a common direction to offset or "shingle" the cards, a probe, and means for moving the probe into a location selected randomly with respect to the offset edge of the deck and moving the deck relative to the probe to engage the leading edge of the probe with a card. The probe separates the engaged card from a contiguous card and cuts the deck into a first sub-deck on one side of the probe, and a second sub-deck, on the other side of the probe. Before and during the cutting and shuffling procedure the cards are preferably supported horizontally, but they may also be supported vertically or in an inclined plane. Means is provided for pinching the second sub-deck against the probe, to thereby facilitate movement of the second sub-deck out of registration with the first sub-deck, in preparation for subsequent shuffling or interleaving the cards.

An object of the present invention is to provide apparatus for use in automatic mechanical or electromechanical card shuffling devices which insures that the deck is randomly cut in preparation for each shuffling of the cards.

Another object of the present invention is to improve the card shuffling device disclosed in U.S. Pat. No. 4,807,884 (invented by the inventor of the present invention, and commonly owned) by providing means for randomly cutting the deck in preparation for each shuffling of the cards.

An important advantage of the present invention is that it makes automatic shuffling machines more efficient and facilitates their use in casinos.

The preferred embodiment of the present invention is designed for use with an automatic card shuffling device such as to the disclosed in U.S. Pat. No. 4,807,884, which repeatedly shuffles a deck of playing cards, then deposits the shuffled deck into a dealing module or shoe.

The present invention is an improvement in a machine like that disclosed in the above patent and is directed to insuring a random cutting of the deck into two sub-decks.

Other objects and advantages of the present invention will become more fully apparent and understood with reference to the following specification and to the appended drawings and claims.

BRIEF DESCRIPTION OF THE DRAWINGS

FIG. 2 shows the un-cut deck supported in stacked, vertical registration on a horizontal support surface prior to being cut. The probe used in cutting the deck and its mounting means are shown to the right of the deck;

FIG. 3 shows the un-cut deck in the thrown, offset or "shingled" state, with the leading edge of the probe moved into engagement with a card;

FIG. 4 shows the deck in a thrown, offset or "shingled" state, after relative movement of the deck with respect to the probe in a direction transverse to the plane of the cards, to thereby cut the deck into a first sub-deck and a second sub-deck;

FIG. 5 shows the cut deck with the probe moved substantially completely beneath a card and with the cards of the deck pushed back into vertical registration;

FIG. 6 shows the cut deck with the first sub-deck supported on the horizontal support surface of the machine and the second sub-deck supported on the probe, with the probe moved horizontally out of vertical registration with the first sub-deck;

FIG. 7 shows the cut deck with the sub-decks moved out of registration and with the second sub-deck supported in a plane substantially in the plane of the first sub-deck, so the sub-decks can be interleaved.

DESCRIPTION OF PREFERRED EMBODIMENT

Card Shuffling Machine Generally

Figure 1:
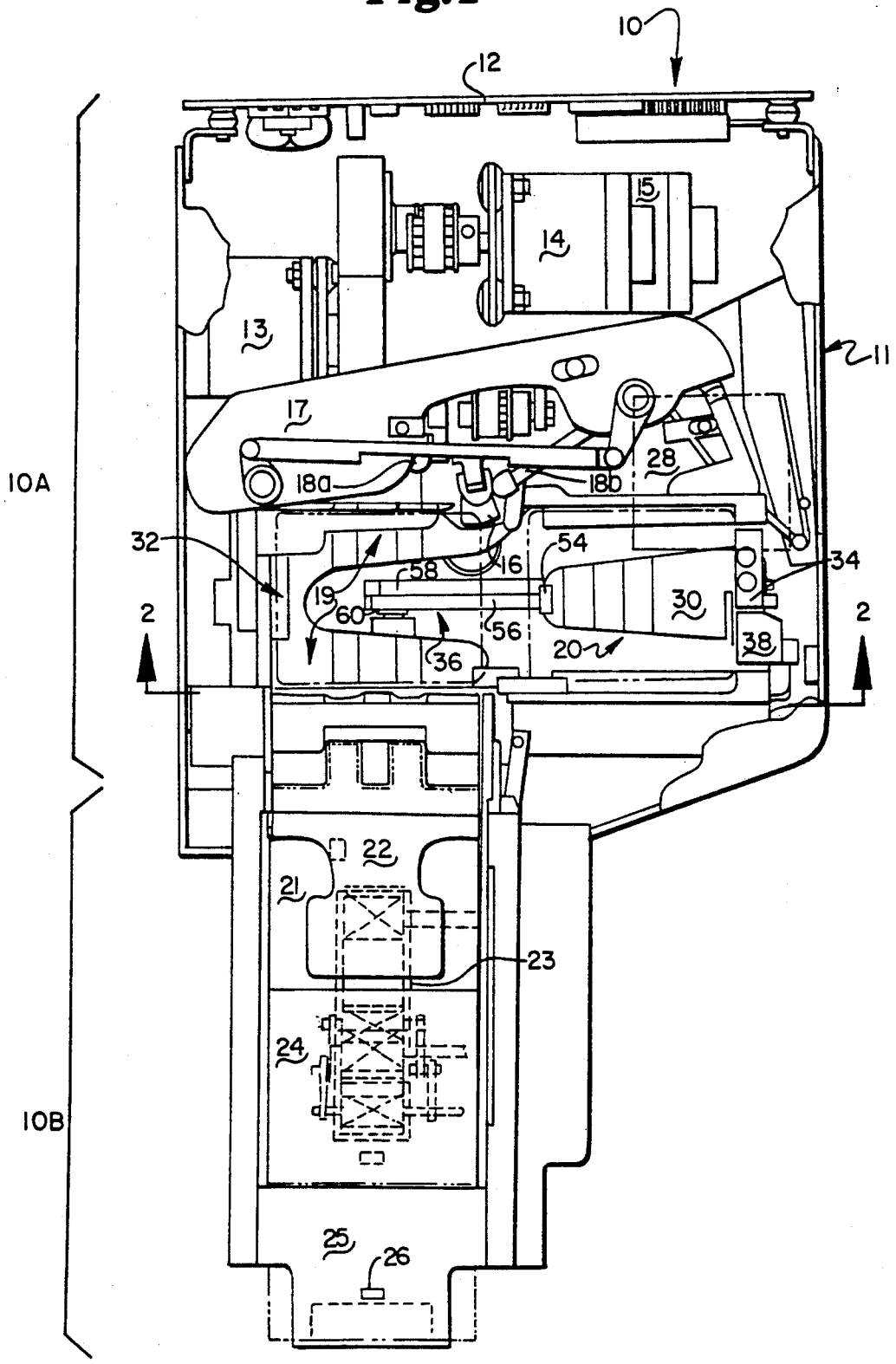
FIG. 1 is a plan view of a typical shuffling machine with portions cut away and with no cards shown for clarity. The shuffling machine shown in FIG. 1 includes a card shuffling module and a card dealing module.
Figure 8:
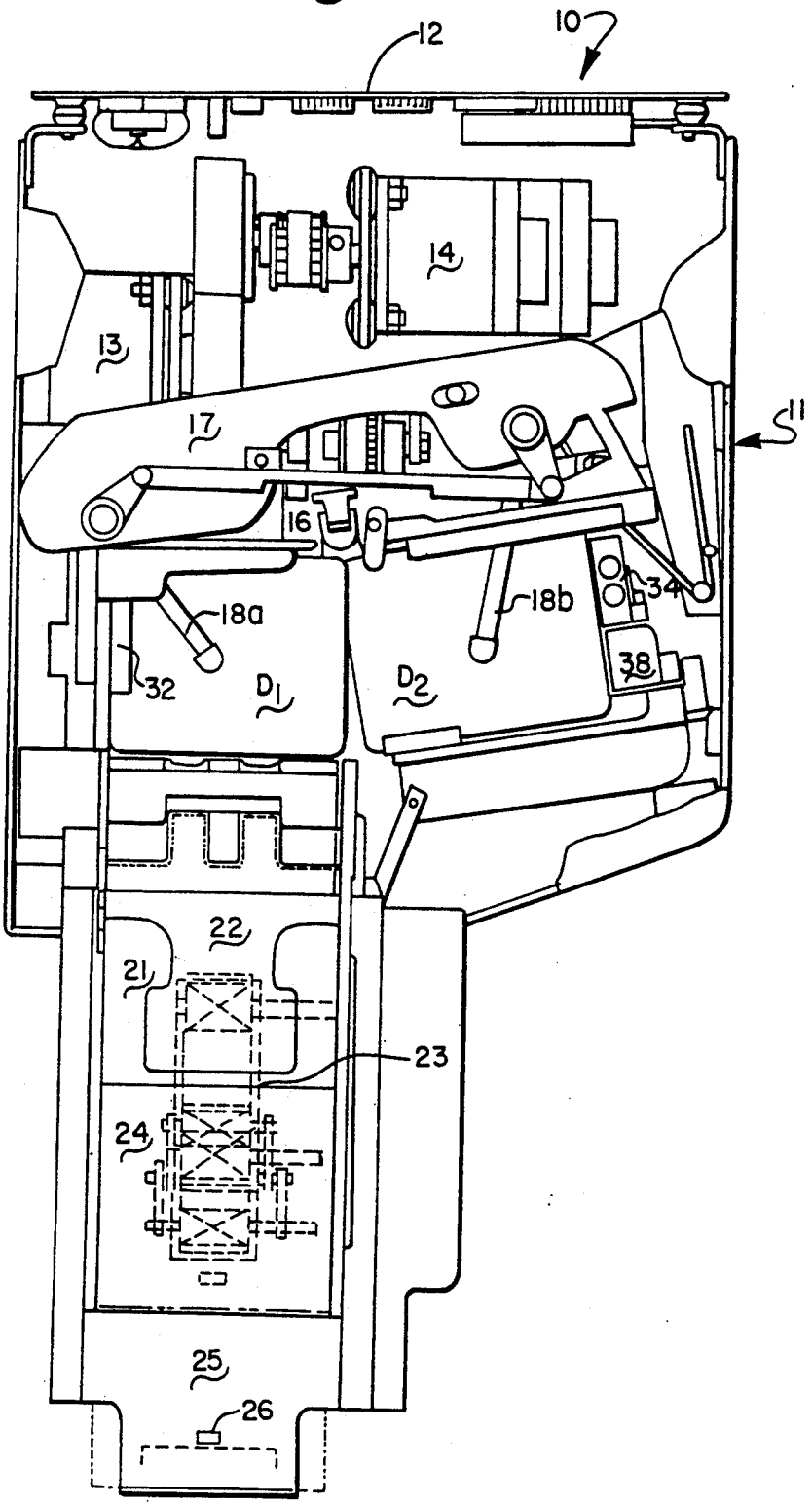
FIG. 8 is a plan view of the shuffling machine shown in FIG. 1 with cards shown in the machine, and with the sub-decks interleaved prior to pushing the cards of the second sub-deck into interleaved vertical registration with the cards of the first sub-deck, to complete the shuffling of the deck.

A typical card shuffling machine with which the random cut apparatus of the present invention may be used is shown in plan view in FIGS. 1 and 8. The major components of the card shuffling machine 10 include a card shuffling module 10A, and a card dealing module 10B, housing 11, circuit board 12, motor 13 for operating certain deck cutting functions, motor 14 for operating the shuffled deck unloading function and motor 15 for operating the mandrel 16, which "riffles" or interleaves the cards. Motor 28 operates other deck cutting functions as explained in greater detail below. Hold down arm assembly 17 includes hold down arms **18*a* and 18*b*, which hold the sub-decks down while they are being riffled by mandrel 16. Machine 10 includes an A-nest 19 and a B-nest 20. Card dealing module 10B includes a shuffled deck holding station 21 beneath card engraving top plate 22, a drive belt 23 for dispensing or dealing cards (from the bottom of the shuffled deck), top plate 24 and shoe 25, which includes photo sensor 26**.

In operation, an unshuffled deck of cards is placed in A-nest 19. It is cut by separation into a first sub-deck, horizontally supported in A-nest 19, and a second sub-deck horizontally supported in B-nest 20. The sub-decks are shuffled together or interleaved by riffling the adjacent corners of the two sub-decks by mandrel 16, as best shown in FIG. 8. The sub-decks are pushed together slightly during the riffling step to insure interleaving of the cards and subsequently pushed completely together into vertical stacked registration. This procedure is repeated a desired number of times, typically three, and the shuffled deck is then pushed into the dealing module 10B. Cards are then dealt into shoe 25 by belt 23 to accumulate the desired number of cards, which comprise a hand, in shoe 25. When the hand is manually removed from shoe 25, photo sensor 26 actuates dealing module 10A to again deal the desired number of cards from the deck in holding station 21 into shoe 25.

Random Cutting Mechanism

The improvement for insuring a random cutting of the deck in the shuffling machine and method described above is shown sequentially in FIGS. 2–7 and generally in FIGS. 1 and 8.

With reference to FIGS. 1 and 8, the major components of the random cutting apparatus of the present invention include probe 30, deck throwing or "shingling" assembly 32, probe mounting block 34, probe moving means 36 and spring loaded pincher or hold-down thumb 38. Horizontal support surface 40 supports the full deck, D, which is randomly cut or separated into two sub-decks, a first sub-deck, $D_1$, which remains supported on horizontal support surface $40_1$, and a second sub-deck, $D_2$, which is supported on probe 30.

The detailed construction of the random cutting mechanism of the present invention is shown in FIGS. 2–7. With reference to FIGS. 2–7, horizontal support surface 40 is mounted on block 44. Means (not shown) is provided for raising and lowering support surface 40 with respect to probe 30 in a direction transverse to the horizontal direction of movement of probe 30.

Deck throwing or shingling assembly 32 includes throwing or shingling hand 42, which is mounted on block 44 for pivotal movement about the axis of driven sheave 46. Driving sheave 48 is mounted on frame 50 and is selectively driven by rubber belt 52 to pivot from the retracted or home position of FIG. 2 through the intermediate position of FIG. 3 to the fully thrown position of FIG. 4, to thereby throw or "shingle" the cards into the position shown in FIG. 4. Shingling hand 42 thus slides the cards of deck D in a single direction (to the right as viewed in FIGS. 2–7) to slide or offset one card substantially uniformly with respect to a contiguous card into the position shown in FIG. 4. This movement throws or "shingles" the deck into the thrown or "shingled" condition, and creates an offset zone, Z, shown in FIG. 4.

With reference to FIGS. 1–7, probe 30 is disposed horizontally, has sufficient area (shown in FIG. 1) to support a card in spatula fashion and is mounted on mounting block 34. Probe 30 is tongue-like in configuration and includes roller 54 on its leading edge or tip. Roller 54 facilitates the entry of probe 30 between cards and prevents an abutting relationship between the edge of a card in deck, D, and the leading edge or tip of probe 30, which would prevent a clean cutting of the deck.

Figures 2, 3, 4, 5, 6, 7:
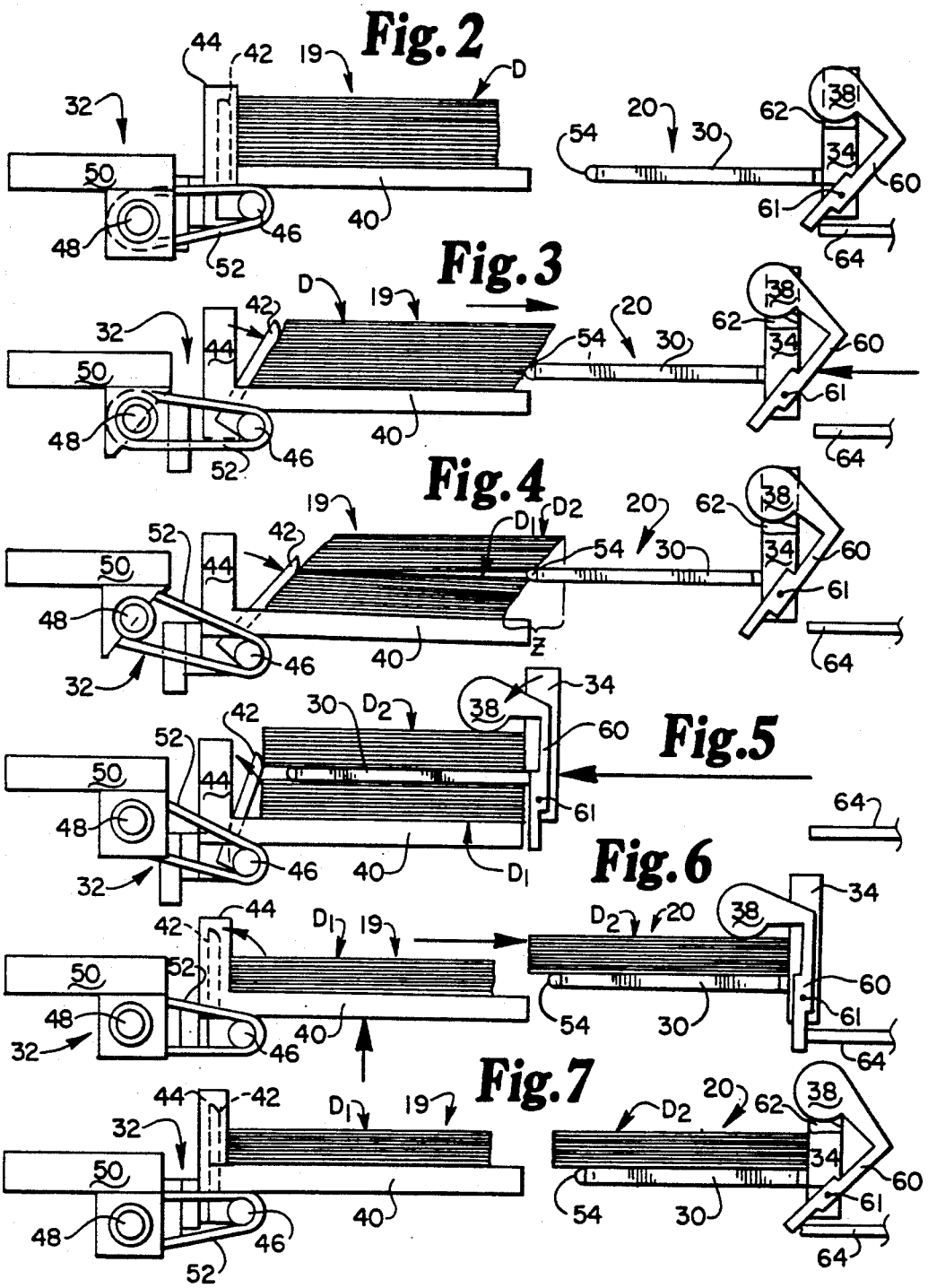
FIGS. 2–7 are sequential side views of the random cutting mechanism of the present invention, all taken on the line 2—2 of FIG. 1.

Means 36 (See FIG. 1) is provided for advancing and retracting probe 30 along its longitudinal axis, which is disposed horizontally as shown in FIGS. 2–7, from a retracted position shown in FIGS. 2 and 7, to a fully advanced position toward deck, D, shown in FIG. 4. Probe advancing and retracting means 36 includes belt 56, track 58, which carries mounting block 34 for horizontal movement, and drive sheave 60 (See FIG. 1). Drive sheave 60 is selectively driven in one direction or the opposite direction to advance and retract probe 30.

The insured random nature of the cutting of the deck, D, into sub-decks $D_1$ and $D_2$ is provided by a microcontroller for randomly selecting one of a plurality of durations for advancement of probe 30. For this purpose drive sheave 60 (See FIG. 1) is selectively driven for the randomly selected time to move probe 30 from the retracted position of FIG. 2 to the fully extended position of FIG. 4. Depending upon the duration randomly selected, probe 30 moves a randomly selected distance (as long as drive sheave 60 is driven) to stop at a randomly selected position in zone, Z. Roller 54 is thus randomly positioned in zone, Z, along a horizontal path. Consequently, when deck, D, is moved transversely to the direction of movement of probe 30 (downwardly in the preferred embodiment), roller 54 engages the offset end of deck, D, at a random location, thereby cutting deck, D.

Figure 9:
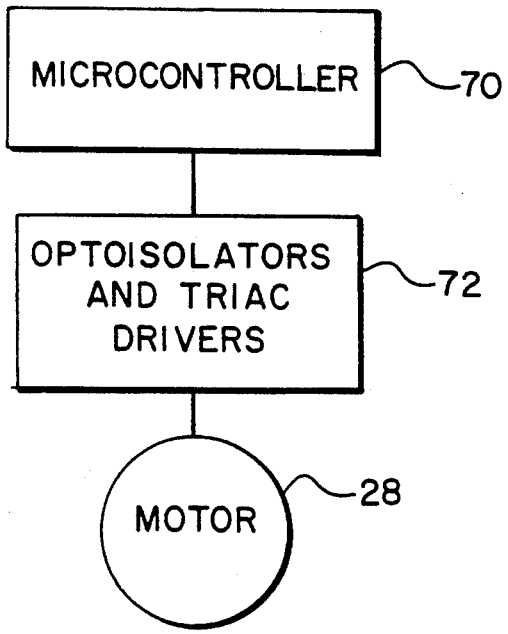
FIG. 9 is a block diagram of the components that randomly advance the probe used in cutting the deck, thereby assuring a random cut of the deck.

The computer and electromechanical components for advancing probe 30 a randomly selected distance to a random position in offset zone, Z, as shown in FIG. 4, are shown in FIG. 9. The components include microcontroller 70, optoisolators and triac drivers 72, and motor 28. Suitable specific components for each of these are as follows:

| Component | Specification |
|---|---|
| Microcontroller - 70 | Part No. 80C32<br>Intel Corporation<br>Santa Clara, CA |
| Optoisolators and Triac Drivers - 72 | Optoisolator - Part No. MOC 3042<br>Motorola Semiconductor Products, Inc.<br>Phoenix, AZ<br>Triac Drivers - Part No. Q401E3<br>Teccor Electronics<br>Irving, TX |
| Motor - 28 | VEXTRA TM Low speed, synchronous motor, Oriental Motor Co., Tokyo, Japan, Product No. Code 2CSM-101, 72 rpm at 60 Hz. |

Preferably, roller 54 is randomly stopped to engage deck, D, in a cutting zone roughly in the range of cards 20 to 32 in a 52 card deck, D. This insures the creation of sub-decks, $D_1$ and $D_2$, with a sufficient number of cards in each to produce a reasonable shuffle. A cut of two cards from a deck of 52, for example, would not produce a reasonable shuffle.

Pincher means in the form of spring loaded pivotally mounted hold-down thumb 38 is provided to pinch second sub-deck $D_2$ against probe 30 to keep the cards of the second sub-deck in stacked vertical registration during retractive movement of probe 30 from the position of FIG. 5 to the position of FIG. 6. Thumb 38 is mounted on arm 60, which is spring loaded by a spring (not shown) to, when released, assume the position shown in FIGS. 5 and 6 by arcuate movement about the horizontal axis 61. Arm 60 and thumb 38 are retained in the cocked position shown in FIGS. 2–4 and 7 by cam surface shoulder 62 on mounting block 34. Thumb 38 is forced into the cocked position by movement of probe 30 and mounting block 34 to the right into the position shown in FIGS. 2–4 and 7 when the lower end of arm 60 engages stop 64, which is fixed. Thumb 38 is released and moved into the pinching position shown in FIGS. 5 and 6, with thumb 38 in engagement with the top card in sub-deck $D_2$, when movement of probe 30 and mounting block 34 to the left (as viewed in FIGS. 2–7) causes the lower end of arm 60 to engage the right end of support means 40, thereby releasing the lower side of thumb 38 from cam surface 62 allowing the spring (not shown) to pivot arm 60 and thumb 38 into the position of FIGS. 5 and 6.

Operation of Random Cutting Mechanism

The operation of the random cutting mechanism is best understood with reference to FIGS. 2–7 and 9. Unshuffled deck, D, is placed in nest 19 on horizontal support 40 in stacked vertical registration as shown in FIG. 2. Motor 13 is actuated to drive sheave 48, belt 52 and sheave 46 to pivot hand 42 into the position shown in FIG. 3. Motor 28 is actuated to advance probe 30 into the position shown in FIG. 3. This position is selected randomly by microcontroller 70 and optoisolator and driver 72 which causes motor 28 to be driven a randomly selected duration, thereby stopping roller 54 of probe 30 at a randomly selected point (left to right) in offset zone, Z. An internal timer in microcontroller 70 interrupts the program every millisecond. When this happens, a random number register is rotated, changing the random selector 1,000 times per second. When probe 30 reaches a selected position it trips a microswitch, which retrieves the number in the random selector and loads it into a software time delay, which times the remaining duration of actuation of motor 28 and completion of travel of probe 30. Probe 30 is thus randomly stopped to randomly position roller 54 in zone, Z.

Horizontal support surface 40 is then lowered with respect to probe 30 causing the offset edge of deck, D, to engage roller 54 thereby separating deck, D, into sub-decks $D_1$ and $D_2$. Motor 28 is again actuated to advance probe 30 into the fully extended position shown in FIG. 5. The lower end of arm 60 engages the end of support 40, which releases thumb 38 from arm 62 to free the spring loaded arm 60 to move into the position shown in FIG. 5, pinching sub-deck, $D_2$, against probe 30. This movement of probe 30 and mounting block 34 also serves to push the cards back into stacked vertical registration. Motor 28 is then actuated again to retract probe 30 and sub-deck, $D_2$, supported on probe 30 in spatula fashion, to the right as shown in FIG. 6, out of vertical registration sub-deck, $D_1$. Horizontal support 40 of nest 19 is then raised to position sub-deck, $D_1$, in substantially the same plane as sub-deck, $D_2$, as shown in FIG. 7, while thumb 38 is moved from the pinching position of FIG. 6 to the retracted or cocked position of FIG. 7.

In the position of FIG. 7, deck, D, has been randomly cut into sub-deck, $D_1$, and sub-deck, $D_2$, with approximately 20–32 cards in each sub-deck and the sub-decks are in proper condition and position to be interleaved as shown in FIG. 8, and described above to complete one shuffle of deck, D.

This process is repeated the desired number of times to achieve a randomly shuffled deck. A random shuffle can be described as an intermixing of the cards in such a way that any single card could end up in any one of 52 locations in the shuffled deck and that its final destination is unpredictable. Studies have shown that seven random shuffles will achieve complete randomness of card location. A lesser number of shuffles will produce a less-randomly but satisfactorily shuffled deck.

It should be noted that an additional random event in cutting the cards in deck, D, is achieved by the present invention in that the degree of throw or "shingling" of deck, D, by the sliding movement of the cards into the offset position shown in FIG. 4 by actuation of hand 42 is random. The throw is random because the co-efficient of friction between contiguous cards, although similar, is not exactly the same and the distance of the sliding movement of the cards is unrestricted, that is, they come to rest only when the frictional drag on the cards overcomes the force imparted to the respective cards by hand 42. Consequently, the degree or angle of offset of the throw of the "shingled" deck shown in FIG. 4 will vary randomly, thereby introducing another random aspect in the cutting of deck, D.

While the preferred embodiment shown and described supports the cards in a horizontal plane throughout the cutting process, it should be recognized that, with certain obvious modifications, the cards could be supported in other attitudes, such as vertical and in an inclined plane.

Other modifications may also be made by those skilled in the art without departing from the scope of the invention, which is to be limited only by the appended claims.

I claim:

1. Apparatus for randomly cutting a deck of cards which comprises:

a. support means for supporting a deck of cards in stacked registration;

b. means for sliding each card in the deck in a common direction and to a greater extent than the preceding card in the deck to thereby offset or shingle the cards in said direction to define an offset zone between the least offset card and the most offset card;

c. a probe having a leading edge;

d. means for moving the leading edge of the probe into said zone;

e. means for randomly determining the location inside said zone to which said leading end of said probe is moved; and f. means for moving the deck relative to the probe transversely to said, direction, to thereby engage the leading edge of the probe with one of the cards in the deck to separate that card and all cards having greater offset than the one card from the contiguous card and all other cards having lesser offset than the one card thereby cutting the deck into two randomly, sized sub-decks.

2. The apparatus of claim 1 wherein said support means supports the deck with the cards in a horizontal plane.

3. The apparatus of claim 2 wherein the probe is tongue-like, is disposed horizontally and has sufficient area to lift and support a card.

4. The apparatus of claim 3 wherein said means for moving the leading edge of the probe into said zone moves the leading edge horizontally.

5. The apparatus of claim 4 and means for moving the leading edge and the probe substantially completely beneath a card to thereby lift and support the card and all cards above it on the probe and cut the deck into a first sub-deck supported on said support means and a second sub-deck supported on said probe.

6. The apparatus of claim 5 and means for pinching the cards comprising the second sub-deck against the probe to thereby hold them in a stationery position against the probe.

7. The apparatus of claim 6 and means for moving the probe and the second sub-deck supported on the probe horizontally out of vertical registration with the first sub-deck.

8. The apparatus of claim 3 and a roller disposed for rotation on a horizontal axis transverse to the direction of movement of the probe at the leading edge of the probe.

9. The apparatus of claim 1 wherein the probe is tongue-like and has sufficient area to support a card.

10. The apparatus of claim 9 and means for moving the leading edge of the probe substantially the full length of a card to thereby completely separate the card from the contiguous card and cut the deck into a first sub-deck on one side of the probe and a second sub-deck on the other side of the probe.

11. The apparatus of claim 10 and means for pinching the cards comprising the second sub-deck against the probe to thereby hold them against the probe.

12. The apparatus of claim 11 and means for moving the probe and the second sub-deck pinched against the probe out of registration with the first sub-deck.

* * * * *